US005738314A

United States Patent [19]

Davis

[11] Patent Number: 5,738,314

[45] Date of Patent: Apr. 14, 1998

[54] COLLAPSIBLE BAG HOLDER APPARATUS

[76] Inventor: Jodi Davis, 240 E. Robindale Rd., Las Vegas, Nev. 89123

[21] Appl. No.: 648,727

[22] Filed: May 16, 1996

[51] Int. Cl.[6] ..... A63B 55/04

[52] U.S. Cl. ..... 248/97; 248/175

[58] Field of Search ..... 248/97, 99, 100, 248/101, 150, 153, 175

[56] References Cited

U.S. PATENT DOCUMENTS

| | | | |
|---|---|---|---|
| D. 337,405 | 7/1993 | Wolters | D34/5 |
| D. 351,268 | 10/1994 | Kittredge | D34/5 |
| D. 353,695 | 12/1994 | Turner | D34/5 |
| 1,278,385 | 9/1918 | Rickard | 248/175 |
| 3,627,242 | 12/1971 | Vandermast | 248/97 |
| 3,905,406 | 9/1975 | Cruse | 141/390 |
| 4,469,300 | 9/1984 | Valesko | 248/97 |
| 4,562,983 | 1/1986 | Klefbeck | 248/97 |
| 4,728,070 | 3/1988 | Engelbrecht | 248/303 |
| 4,832,291 | 5/1989 | Nelson et al. | 248/99 |
| 4,951,903 | 8/1990 | Frey | 248/99 |
| 4,998,694 | 3/1991 | Barteaux | 248/100 |
| 5,014,944 | 5/1991 | Malik et al. | 248/97 |
| 5,016,844 | 5/1991 | Garvin | 248/97 |
| 5,183,226 | 2/1993 | Brooks | 248/97 |
| 5,226,621 | 7/1993 | Skoff | 248/97 |
| 5,393,023 | 2/1995 | Callan | 248/97 |

*Primary Examiner*—Leslie A. Braun
*Assistant Examiner*—Anita M. King

[57] ABSTRACT

A collapsible bag holder apparatus includes a fence member, leg members, and hinge members connected between the leg members and the fence member. The hinge members permit the leg members to be oriented with respect to the fence member in either an erect orientation or a collapsed orientation. Angle-control members are connected to the hinge members for contacting the fence member and for limiting an orientation angle between the fence member and the leg members when the leg members are in the erect orientation. The angle-control members are positioned below the fence member for contacting a bottom side of the fence member. An angle-control member is connected between two hinge members which are connected to two leg members and serves as a bridge between the two hinge members. The leg members, the hinge members, and the angle-control members are grouped together in two separate groups, a first leg group and a second leg group. The fence member has a longitudinal fence length. When in the erect orientation, the leg ends of the first leg group and the leg ends of the second leg group have a footprint which has a longitudinal footprint length. The longitudinal fence length is less than the longitudinal footprint length. The fence member includes curved fence portions, and the angle-control members include curved portions which are registrable with the curved fence portions. The fence member is in a form of a four-sided structure wherein each side is curved.

11 Claims, 3 Drawing Sheets

FIG 1
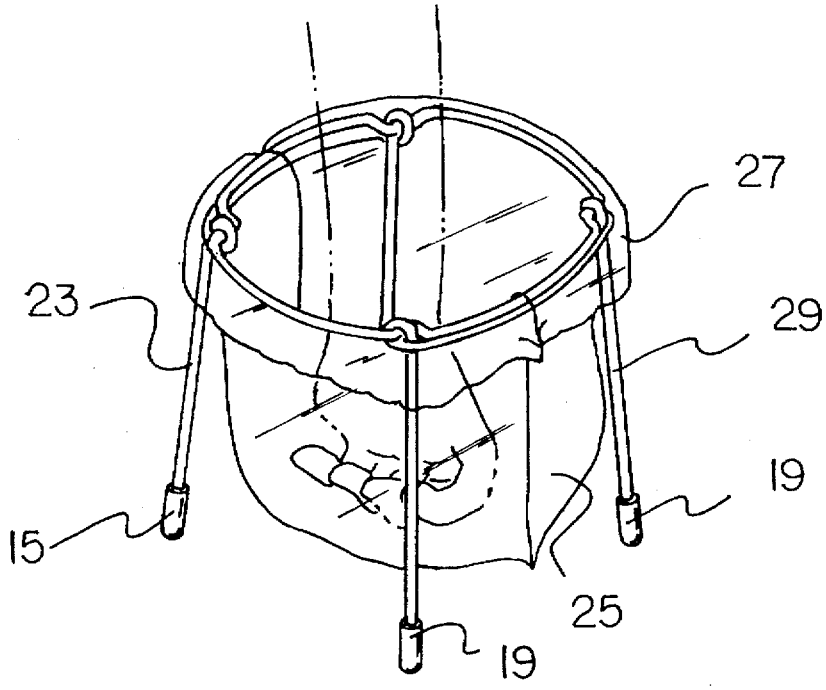
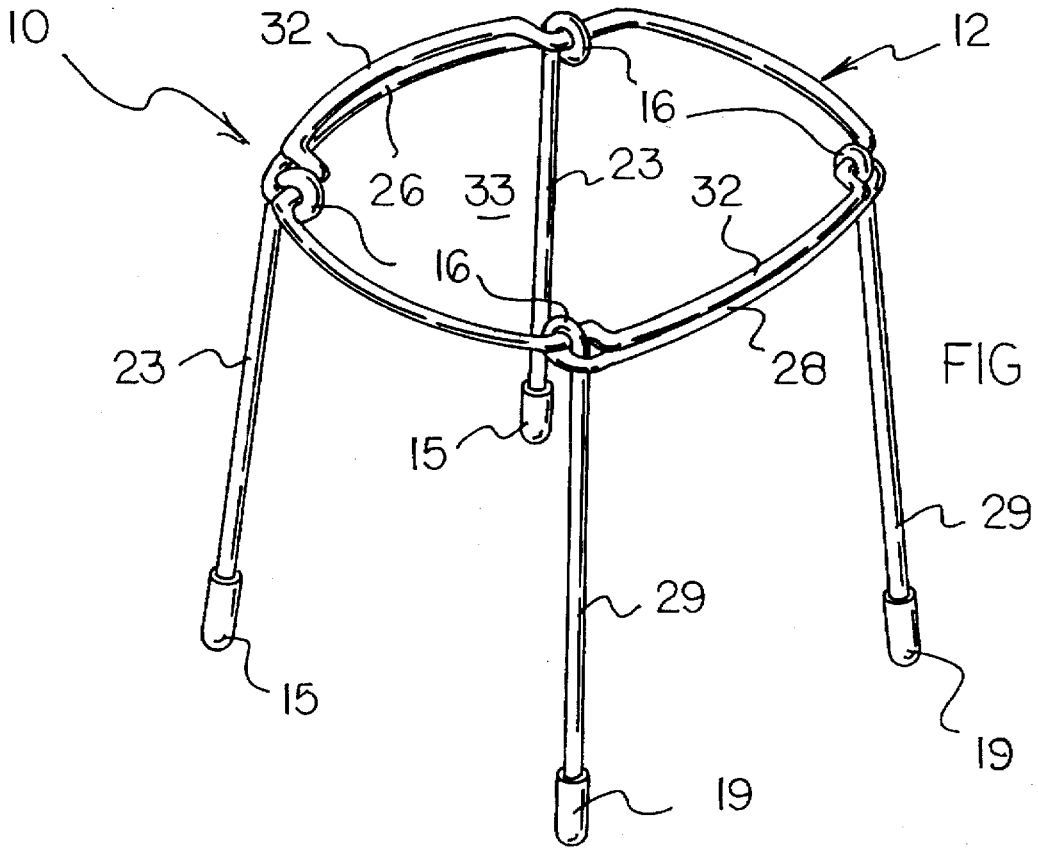
FIG 2

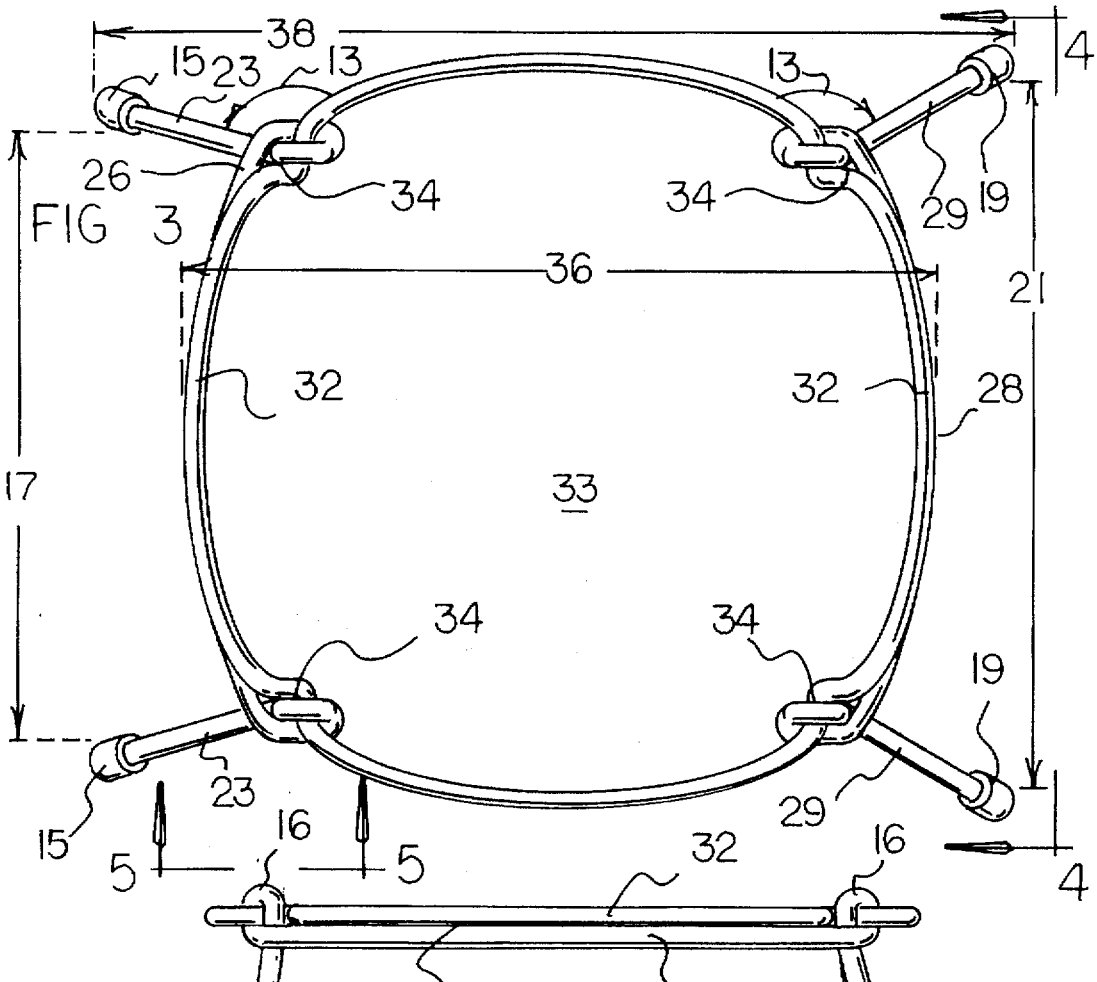
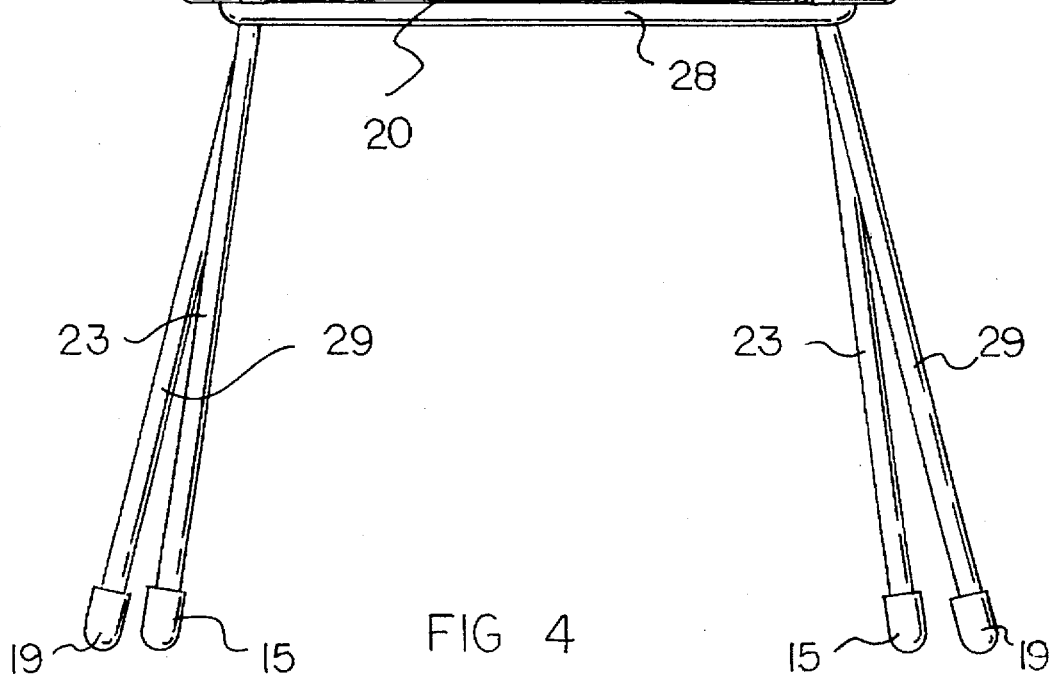
FIG 4

FIG 5
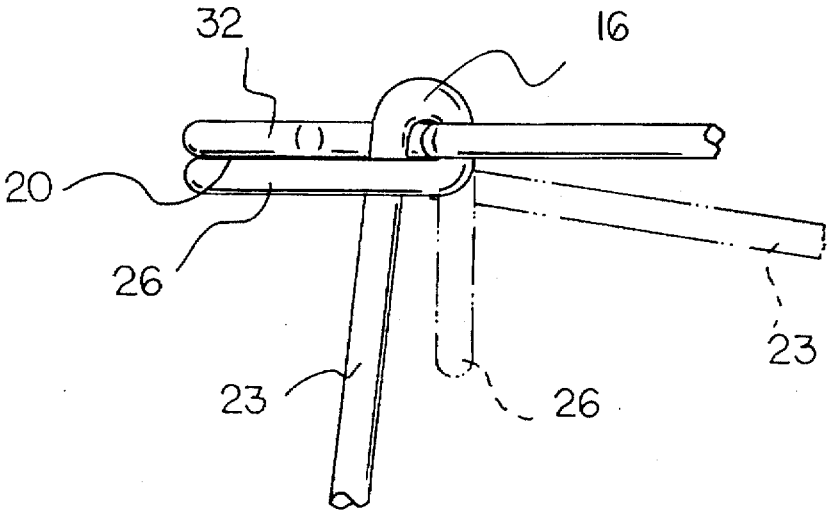
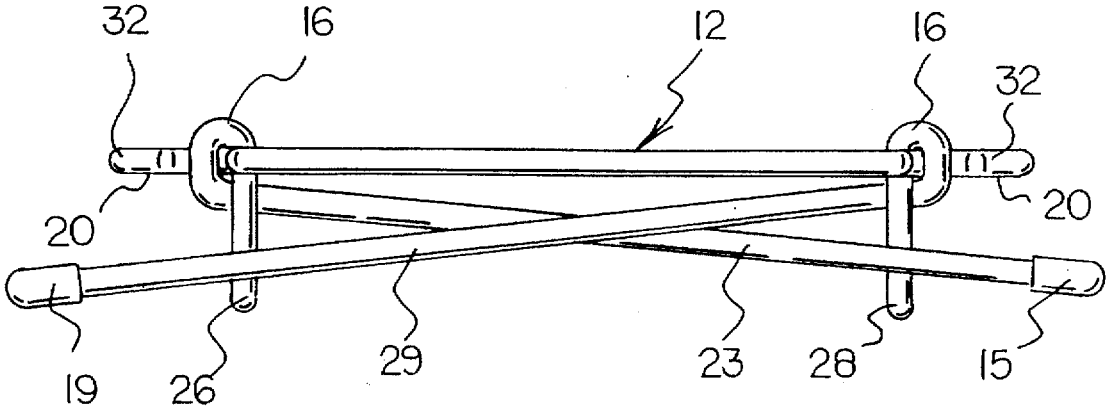
FIG 6

COLLAPSIBLE BAG HOLDER APPARATUS

BACKGROUND OF THE INVENTION

1. Field of the Invention

The present invention relates generally to bag holders and, more particularly, to bag holders that can readily be collapsed and set up again.

2. Description of the Prior Art

Bags, such as food storage bags, are generally made from flaccid material and are generally not self-standing. As a result, unless some aid is employed, it is often necessary for a person to hold such a bag open with one hand while filling the bag with the other hand. There are times, however, when it is difficult to fill a bag with the use of only one hand. Many times, two hands are required. Therefore, some device is employed for holding the bag open so that two hands can be used for filling the bag.

Throughout the years, a number of innovations have been developed relating to devices for holding a flaccid bag open for filling, and the following U.S. patents are representative of some of those innovations: 4,832,291, 4,951,903, 4,998,694, 5,016,844, 5,183,226, 5,226,621, 5,393,023, Des. 337,405, Des. 351,268, and Des. 353,695. More specifically, each of U.S. Pat. Nos. 4,832,291, 4,951,903, and 4,998,694 discloses a bag holder for a flaccid bag which cannot self-support a bag in a vertical orientation. U.S. Pat. No. 4,832,291 discloses a bag holder that is supported on a horizontal surface, such as the ground. Each of U.S. Pat. Nos. 4,951,903 and 4,998,694 discloses a bag holder that is supported by a wall in a vertical orientation. In view of the above, it would be desirable if a bag holder for a flaccid bag were provided which can self-support a bag in a vertical orientation.

Each of U.S. Pat. Nos. 5,016,844, 5,183,226, 5,226,621, Des. 337,405, Des. 351,268, and Des. 353,695 discloses a bag holder that is self-standing and supports a bag in a vertical orientation. To collapse these bag holders, such as for storage purposes, the respective bag holders must be disassembled; that is, the parts are separated from one another. When parts are separated from one another, there is a risk that some of the parts will be lost. As a result, it may not be possible to reassemble such bag holders. In this respect, it would be desirable if a bag holder for a flaccid bag were provided which, when collapsed, is not disassembled.

U.S. Pat. No. 5,393,023 discloses a collapsible bag holder for a flaccid bag that can be collapsed for storage without disassembling the components. Instead, the components are connected together with pivoted connections. However, with this device, two complete rings are required, an upper ring and a lower ring. The lower ring is the large of the two rings, even though the lower ring need not directly contact a bag that is supported. In terms of directly contacting a bag, the lower ring is superfluous. In this respect, it would be desirable if a bag holder for a flaccid bag were provided which does not include a ring which does directly contact a bag that is supported. In addition, the upper and lower rings are connected together with struts that keep the bag holder in a vertical orientation. Each strut requires two pivoting connections, one to the upper ring and one to the lower ring. Thus, for three struts, six pivoting connections are required. To reduce the number of pivoting connections, it would be desirable if a bag holder for a flaccid bag does not require two pivoting connection for each support that keeps the bag support in a vertical orientation.

U.S. Pat. No. 4,728,070 may be of interest for its disclosure of for supporting thin, collapsible, self-handle, plastic trash bags.

Still other features would be desirable in a collapsible bag holder apparatus. For example, it would be desirable if a collapsible bag holder apparatus had a plurality of legs which have feet that are independent from one another. To provide stability, it would be desirable if the feet of the legs of a collapsible bag holder apparatus had a larger footprint than a ring which directly contacts the flaccid bag. To rapidly set up a collapsed bag holder apparatus, it would be desirable if more than one leg could be oriented vertically with a single set up motion. Conversely, to rapidly collapse a bag holder apparatus, it would be desirable if more than one leg could be collapsed with a single collapsing motion. When the collapsible bag holder apparatus is stored, it would be desirable if its collapsed legs could be spaced apart from one another so that the collapsed legs do not get tangled with one another.

Thus, while the foregoing body of prior art indicates it to be well known to use collapsible bag holders for supporting flaccid bags, the prior art described above does not teach or suggest a collapsible bag holder apparatus for a flaccid bag which has the following combination of desirable features: (1) holds a flaccid bag open so that two hands can be used for filling the bag; (2) can self-support a flaccid bag in a vertical orientation; (3) is not disassembled when collapsed; (4) does not include a ring which does not directly contact a bag; (5) does not require two pivoting connections for each support that keeps the flaccid bag support in a vertical orientation; (6) has a plurality of legs which have feet that are independent from one another; (7) has legs which provide a footprint that is larger than a ring which directly contacts the flaccid bag; (8) provides that more than one leg can be oriented vertically with a single setting up motion; (9) provides that more than one leg can be collapsed with a single collapsing motion; and (10) provides legs that are spaced apart from one another so that the collapsed legs do not get tangled with one another. The foregoing desired characteristics are provided by the unique collapsible bag holder apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a collapsible bag holder apparatus which includes a fence member, at least three leg members, and hinge members connected between the leg members and the fence member. The hinge members permit the leg members to be oriented with respect to the fence member in either an erect orientation or a collapsed orientation. Angle-control members are connected to the hinge members for contacting the fence member and for limiting an orientation angle between the fence member and the leg members when the leg members are in the erect orientation. The angle-control members are positioned below the fence member for contacting a bottom side of the fence member.

An angle-control member is connected between two hinge members which are connected to two leg members and serves as a bridge between the two hinge members. The leg members, the hinge members, and the angle-control members are grouped together in two separate groups, a first leg group and a second leg group. The first leg group includes two first-group leg members, two first-group hinge members, and a first angle-control member connected between the two first-group hinge members. The first-group leg members include first leg ends which are separated by a first leg ends separation distance. The two first-group leg members, the two first-group hinge members, and the first angle-control member are formed as an integrated, unified structure.

The second leg group includes two second-group leg members, two second-group hinge members, and a second angle-control member connected between the two second-group hinge members. The second-group leg members include second leg ends which are separated by a second leg ends separation distance. The first leg ends separation distance is less than the second leg ends separation distance. The two second-group leg members, the two second-group hinge members, and the second angle-control member are formed as an integrated, unified structure.

The fence member has a longitudinal fence length. The first leg ends and the second leg ends have a footprint which has a longitudinal footprint length. The longitudinal fence length is less than the longitudinal footprint length.

The fence member includes indent portions for receiving the hinge members. The indent portions are substantially right-angled indent portions. The fence member includes curved fence portions, and the angle-control members include curved portions which are registrable with the curved fence portions. The fence member is in a form of a four-sided structure wherein each side is curved.

In accordance with another aspect of the invention, a method is provided for adding material to a bag. With the method, a collapsed bag holder apparatus is obtained which has a fence member, which has a first leg group which includes first leg members, first hinge members connected to the fence member, and a first angle-control member, and which has a second leg group which includes second leg members, second hinge members connected to the fence member, and a second angle-control member. The bag holder apparatus is erected by moving the first angle-control member to the fence member and by moving the second angle-control member to the fence member. Such movements can be obtained by a person's squeezing each of the angle-control members together with the fence member. A bag is placed within a space defined by the fence member, A lip portion of the bag is folded over the fence member, whereby the bag holder apparatus keeps the bag open. Material, such as food, is added to the bag.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining a preferred embodiment of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved collapsible bag holder apparatus which has all of the advantages of the prior art and none of the disadvantages.

It is another object of the present invention to provide a new and improved collapsible bag holder apparatus which may be easily and efficiently manufactured and marketed.

It is a further object of the present invention to provide a new and improved collapsible bag holder apparatus which is of durable and reliable construction.

An even further object of the present invention is to provide a new and improved collapsible bag holder apparatus which is susceptible of a low cost of manufacture with regard to both materials and labor, and which accordingly is then susceptible of low prices of sale to the consuming public, thereby making such collapsible bag holder apparatus available to the buying public.

Still yet a further object of the present invention is to provide a new and improved collapsible bag holder apparatus which holds a flaccid bag open so that two hands can be used for filling the bag.

Still another object of the present invention is to provide a new and improved collapsible bag holder apparatus that can self-support a flaccid bag in a vertical orientation.

Yet another object of the present invention is to provide a new and improved collapsible bag holder apparatus which is not disassembled when collapsed.

Even another object of the present invention is to provide a new and improved collapsible bag holder apparatus that does not include a ring which does not directly contact a bag.

Still a further object of the present invention is to provide a new and improved collapsible bag holder apparatus which does not require two pivoting connections for each support that keeps the flaccid bag support in a vertical orientation.

Yet another object of the present invention is to provide a new and improved collapsible bag holder apparatus that has a plurality of legs which have feet that are independent from one another.

Still another object of the present invention is to provide a new and improved collapsible bag holder apparatus which has legs which provide a footprint that is larger than a ring which directly contacts the flaccid bag.

Yet another object of the present invention is to provide a new and improved collapsible bag holder apparatus that provides that more than one leg can be oriented vertically with a single setting up motion.

Still a further object of the present invention is to provide a new and improved collapsible bag holder apparatus that provides that more than one leg can be collapsed with a single collapsing motion.

Yet another object of the present invention is to provide a new and improved collapsible bag holder apparatus which provides legs that are spaced apart from one another so that the collapsed legs do not get tangled with one another.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 1 is a perspective view showing a preferred embodiment of the collapsible bag holder apparatus of the invention in a vertical orientation and in use with a flaccid bag supported by the apparatus and a person's hand opening the flaccid bag.

FIG. 2 is a perspective view of the embodiment of the invention shown in FIG. 1 with the flaccid bag and the person's hand removed.

FIG. 3 is an enlarged top view of the embodiment of the invention shown in FIG. 2.

FIG. 4 is a side view of the embodiment of the invention shown in FIG. 3 taken along line 4–4 thereof.

FIG. 5 is an enlarged front view of a portion of the embodiment of the invention shown in FIG. 3 taken along lines 5—5 thereof; broken lines show this portion of the invention in a collapsed orientation.

FIG. 6 is a front view of the embodiment of the invention shown in FIG. 3 in a collapsed orientation for storage.

DESCRIPTION OF THE PREFERRED EMBODIMENT

With reference to the drawings, a new and improved collapsible bag holder apparatus embodying the principles and concepts of the present invention will be described.

Turning to FIGS. 1–6, there is shown an exemplary embodiment of the collapsible bag holder apparatus of the invention generally designated by reference numeral 10. In its preferred form, collapsible bag holder apparatus 10 includes a fence member 12, four leg members, and hinge members 16 connected between the leg members and the fence member 12. The hinge members 16 permit the leg members to be oriented with respect to the fence member 12 in either an erect orientation or a collapsed orientation. Angle-control members are connected to the hinge members 16 for contacting the fence member 12 and for limiting an orientation angle 13 between the fence member 12 and the leg members when the leg members are in the erect orientation. The angle-control members are positioned below the fence member 12 for contacting a bottom side 20 of the fence member 12.

An angle-control member is connected between two hinge members 16 which are connected to two leg members and serves as a bridge between the two hinge members 16. The leg members, the hinge members 16, and the angle-control members are grouped together in two separate groups, a first leg group and a second leg group. The first leg group includes two first-group leg members 23, two first-group hinge members 16, and a first angle-control member 26 connected between the two first-group hinge members 16. The first-group leg members 23 include first leg ends 15 which are separated by a first leg ends separation distance 17. The two first-group leg members 23, the two first-group hinge members 16, and the first angle-control member 26 are formed as an integrated, unified structure.

The second leg group includes two second-group leg members 29, two second-group hinge members 16, and a second angle-control member 28 connected between the two second-group hinge members 16. The second-group leg members 29 include second leg ends 19 which are separated by a second leg ends separation distance 21. The first leg ends separation distance 17 is less than the second leg ends separation distance 21. The two second-group leg members 29, the two second-group hinge members 16, and the second angle-control member 28 are formed as an integrated, unified structure.

The fence member 12 has a longitudinal fence length 36. The first leg ends 15 and the second leg ends 19 have a footprint which has a longitudinal footprint length 38. The longitudinal fence length 36 is less than the longitudinal footprint length 38. The greater length of the longitudinal footprint length 38 over the longitudinal fence length 36 provides for stability when the collapsible bag holder apparatus 10 of the invention is in an erect orientation.

The fence member 12 includes indent portions for receiving the hinge members 16. The indent portions are substantially right-angled indent portions 34. The fence member 12 includes curved fence portions 32, and the angle-control members include curved portions which are registrable with the curved fence portions 32. The fence member 12 is in a form of a four-sided structure wherein each side is curved.

In using the collapsible bag holder apparatus 10 of the invention, material can be added to a bag 25, such as a flaccid, transparent food storage bag shown in FIG. 1. To do so, the following steps are taken. collapsed bag holder apparatus is obtained which has a fence member 12, which has a first leg group which includes first leg members, first hinge members 16 connected to the fence member 12, and a first angle-control member, and which has a second leg group which includes second leg members, second hinge members 16 connected to the fence member 12, and a second angle-control member. A bag holder apparatus 10 in a collapsed orientation is shown in FIG. 6. The bag holder apparatus 10 is erected by moving the first angle-control member to the fence member 12 and by moving the second angle-control member to the fence member 12. Such movements can be obtained by a person's squeezing each of the angle-control members together with the fence member 12. A bag 25 is placed within a space 33 defined by the fence member 12, such as shown in FIG. 1 lip portion 27 of the bag 25 is folded over the fence member 12, whereby the bag holder apparatus 10 keeps the bag 25 open. Material, such as food, is added to the bag 25. If desired, a person can use one hand to fully open the bag 25, as shown in FIG. 1, prior to adding material to the bag 25.

When the material addition step is complete, the bag 25 can be removed from the bag holder apparatus 10 and sealed. To collapse the bag holder apparatus 10 for storage, the first angle-control member 26 is moved away from one curved fence portion 32, such as shown by the broken lines in FIG. 5 and the solid lines in FIG. 6, and the second angle-control member 28 is moved away from another curved fence portion 32, such as illustrated in FIG. 6. In the collapsed orientation, the collapsible bag holder apparatus 10 of the invention takes up less storage space, such as drawer space, than in the erected orientation which is illustrated in FIGS. 1–4.

The components of the collapsible bag holder apparatus of the invention can be made from inexpensive and durable metal and plastic materials. As an example, one-eighth inch copper rod can be used for fabricating the collapsible bag holder apparatus 10 of the invention.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved collapsible bag holder apparatus that is low in cost, relatively simple in design and operation, and which may advantageously be used to hold a flaccid bag open so that two hands can be used for filling the bag. With the invention, a collapsible bag holder apparatus is provided which can self-support a flaccid bag in a vertical orientation. With the invention, a collapsible bag holder apparatus is provided which is not disassembled when collapsed. With the invention, a collapsible bag holder apparatus is provided which does not include a ring which does not directly contact a bag. With the invention, a collapsible bag holder apparatus is provided which does not require two pivoting connections for each support that keeps the flaccid bag support in a vertical orientation.

In addition, with the invention, a collapsible bag holder apparatus is provided which has a plurality of legs which have feet that are independent from one another. With the invention, a collapsible bag holder apparatus is provided which has legs which provide a footprint that is larger than a ring which directly contacts the flaccid bag. With the invention, a collapsible bag holder apparatus provides that more than one leg can be oriented vertically with a single setting up motion. With the invention, a collapsible bag holder apparatus provides that more than one leg can be collapsed with a single collapsing motion. With the invention, a collapsible bag holder apparatus provides legs that are spaced apart from one another so that the collapsed legs do not get tangled with one another.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the foregoing Abstract provided at the beginning of this specification is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by LETTERS PATENT of the United States is as follows:

1. A collapsible bag holder apparatus, comprising:

an annular fence member, first and second leg members, hinge members connected between each of said leg members and said fence member, wherein said hinge members permit each of said leg members to be oriented with respect to said fence member in either an erect orientation or a collapsed orientation, first and second angle-control members for contacting a portion of said annular fence member for limiting an orientation angle between said fence member and said leg members when said leg members are in said erect orientation, wherein said annular fence member includes indent portions for receiving said hinge members and for defining said portion of said annular fence member contacted by each said angle-control member, respectively, wherein said first and second leg members each include respectively a first leg portion, a second leg portion, and a corresponding angle-control member joined integrally between said first leg portion and said second leg portion by means of a first hinge member and a second hinge member respectively, and wherein said first and second hinge members each includes a curved portion connected between a corresponding leg portion and said angle-control member, said curved portion being received at least partially within a corresponding indent portion of said fence member.

2. The apparatus of claim 1 wherein said angle-control members are positioned below said fence member for contacting a bottom side of said fence member.

3. The apparatus of claim 1 wherein said leg members, said hinge members, and said angle-control members are grouped together in two separate groups, a first leg group and a second leg group.

4. The apparatus of claim 3 wherein said first leg group includes:

two first-group leg members, two first-group hinge members, and said first angle-control member connected between said two first-group hinge members, wherein said first-group leg members include first leg ends which are separated by a first leg ends separation distance.

5. The apparatus of claim 4 wherein said two first-group leg members, said two first-group hinge members, and said first angle-control member are formed as an integrated, unified structure.

6. The apparatus of claim 3 wherein said second leg group includes:

two second-group leg members, two second-group hinge members, and said second angle-control member connected between said two second-group hinge members, wherein said second-group leg members include second leg ends which are separated by a second leg ends separation distance, and said first leg ends separation distance is less than said second leg ends separation distance.

7. The apparatus of claim 6 said two second-group leg members, said two second-group hinge members, and said second angle-control member are formed as an integrated, unified structure.

8. The apparatus of claim 6 wherein:

said fence member has a longitudinal fence length, said first leg ends and said second leg ends have a footprint which has a longitudinal footprint length, and said longitudinal fence length is less than said longitudinal footprint length.

9. The apparatus of claim 1 wherein said indent portions include substantially right-angled indent portions.

10. The apparatus of claim 1 wherein:

said fence member includes curved fence portions, and said angle-control members include curved portions which are registrable with said curved fence portions.

11. The apparatus of claim 1 wherein said fence member is in a form of a four-sided fence wherein each side is curved.

* * * * *